US009308759B2

(12) United States Patent
Ishizuka

(10) Patent No.: US 9,308,759 B2
(45) Date of Patent: Apr. 12, 2016

(54) RECORDING DEVICE INCLUDING CONVEYOR BELT AND WIPER BLADE

(71) Applicant: SEIKO EPSON CORPORATION, Tokyo (JP)

(72) Inventor: Hirotaka Ishizuka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 1 day.

(21) Appl. No.: 14/529,855

(22) Filed: Oct. 31, 2014

(65) Prior Publication Data

US 2015/0130882 A1 May 14, 2015

(30) Foreign Application Priority Data

Nov. 8, 2013 (JP) ..... 2013-231915

(51) Int. Cl.
*B41J 2/165* (2006.01)
*B41J 29/17* (2006.01)
*B41J 11/00* (2006.01)

(52) U.S. Cl.
CPC ..... *B41J 29/17* (2013.01); *B41J 11/007* (2013.01)

(58) Field of Classification Search
CPC ..... B41J 29/17; B41J 11/007
USPC ..... 347/33, 22, 28
See application file for complete search history.

(56) References Cited

U.S. PATENT DOCUMENTS

| | | | | |
|---|---|---|---|---|
| 2004/0046852 | A1* | 3/2004 | Pham et al. | 347/104 |
| 2007/0263028 | A1 | 11/2007 | Zengo et al. | |
| 2008/0238977 | A1* | 10/2008 | Nishizaki et al. | 347/16 |
| 2010/0245432 | A1 | 9/2010 | Takeda et al. | |
| 2013/0235120 | A1* | 9/2013 | Hirabayashi et al. | 347/22 |

FOREIGN PATENT DOCUMENTS

| | | | |
|---|---|---|---|
| EP | 2371568 | A2 | 10/2011 |
| EP | 2390097 | A2 | 11/2011 |
| EP | 2447076 | A1 | 5/2012 |
| JP | 2004-223887 | A | 8/2004 |
| JP | 2012-116619 | A | 6/2012 |

OTHER PUBLICATIONS

Extended European Search Report for European Patent Application No. 14192342.5 dated Feb. 4, 2015.

* cited by examiner

*Primary Examiner* — Henok Legesse
(74) *Attorney, Agent, or Firm* — Global IP Counselors, LLP

(57) ABSTRACT

To suppress cleaning fluid from remaining on a conveyor belt and dirtying of a medium to be recorded by the cleaning fluid when applying the cleaning fluid to clean the conveyor belt. This is equipped with a conveyor belt 2 configured to support a medium to be recorded P on a support surface S and conveying it, and wiper blades 13 and 16 abuttable with the conveyor belt 2. The wiper blades 13 and 16 are more hydrophilic than the support surface S. With this configuration, it is possible to suppress the cleaning fluid from remaining on the conveyor belt and dirtying the medium to be recorded with the cleaning fluid when applying the cleaning fluid to clean the conveyor belt.

15 Claims, 8 Drawing Sheets

RECORDING DEVICE INCLUDING CONVEYOR BELT AND WIPER BLADE

CROSS-REFERENCE TO RELATED APPLICATIONS

This application claims priority to Japanese Patent Application No. 2013-231915 filed on Nov. 8, 2013. The entire disclosure of Japanese Patent Application No. 2013-231915 is hereby incorporated herein by reference.

BACKGROUND

1. Technical Field

The present invention relates to a recording device.

2. Related Art

From the past, recording devices equipped with a conveyor belt for supporting a medium to be recorded and conveying it have been used. Among these, a recording device capable of cleaning the conveyor belt has been disclosed.

For example, disclosed in JP-A-2012-116619 (Patent Document 1) is a recording device equipped with a brush roller that adheres cleaning fluid to a conveyor belt, and a plurality of blades.

SUMMARY

However, with the recording device for applying cleaning fluid and cleaning a conveyor belt such as the one disclosed in Patent Document 1, there were cases when the cleaning fluid remained on the conveyor belt, and the medium to be recorded was dirtied by the cleaning fluid.

In light of that, an advantage of the present invention is to suppress dirtying of the medium to be recorded by the cleaning fluid due to the cleaning fluid remaining on the conveyer belt when applying the cleaning fluid to clean the conveyor belt.

The recording device of a first aspect of the present invention for solving the problem noted above includes a conveyor belt configured to support a medium to be recorded on a support surface and convey the medium to be recorded, and a wiper blade abuttable with the conveyor belt. The wiper blade is more hydrophilic than the support surface.

Typically, water and aqueous solutions are used as the cleaning fluid for the conveyor belt.

With this aspect, the wiper blade is more hydrophilic than the support surface. Because of this, the conveyor belt cleaning fluid is more easily wetted on the wiper blade than on the support surface, and it is possible to move the cleaning fluid from the support surface to the wiper blade. Specifically, it is possible to suppress the cleaning fluid from remaining on the conveyor belt, and having the medium to be recorded dirtied by the cleaning fluid.

The recording device of the second aspect of the present invention includes a conveyor belt configured to support a medium to be recorded on a support surface and conveying the medium to be recorded, and a wiper blade disposed at a position where the wiper blade contacts with the cleaning fluid applied to the conveyor belt, and does not contact with the support surface. The wiper blade is more hydrophilic than the support surface.

Here, "that contacts with the cleaning fluid applied to the conveyor belt" means not that it is necessary to contact all the cleaning fluid applied to the conveyer belt, but that it is sufficient to contact a portion of the cleaning fluid applied to the conveyor belt.

With this aspect, the wiper blade is provided at a position that is not in contact with the support surface contacting the cleaning fluid applied to the conveyor belt. Because of this, the cleaning fluid effectively moves from the support surface to the wiper blade, and dirtying of the medium to be recorded by the cleaning fluid is suppressed, and it is possible to suppress wearing of the wiper blade and the support surface due to contact of the wiper blade on the support surface.

The recording device of the third aspect of the present invention is the first or second aspect, wherein the static contact angle of water to the wiper blade is smaller by 10° or more than the static contact angle of water to the support surface.

With this aspect, the static contact angle of water to the wiper blade is smaller by 10° or more than the static contact angle of water to the support surface. Specifically, the cleaning fluid is sufficiently easier to wet on the wiper blade than the support surface. Thus, it is possible to effectively move the cleaning fluid from the support surface to the wiper blade, and possible to suppress having the cleaning fluid remain on the conveyor belt, and having the medium to be recorded dirtied by the cleaning fluid.

The recording device of the fourth aspect of the present invention is any one of the first through third aspects, wherein the conveyor belt has the support surface that supports the medium to be recorded and is coated by an adhesive agent, and a non-adhesive surface that is not coated by the adhesive agent, the non-adhesive surface is more hydrophilic than the support surface, and the wiper blade is more hydrophilic than the non-adhesive surface.

With this aspect, the non-adhesive surface is more hydrophilic than the support surface, and the wiper blade is more hydrophilic than the non-adhesive surface. Specifically, with the so-called adhesive belt for which the adhesive agent is coated on the support surface, it is easy for the cleaning fluid to move from the support surface to the non-adhesive surface, and easy for the cleaning fluid to move from the support surface and the non-adhesive surface to the wiper blade. Because of this, it is possible to effectively suppress having the cleaning fluid remain on the support surface of the adhesive belt as the conveyor belt, and having the medium to be recorded dirtied by the cleaning fluid.

The recording device of the fifth aspect of the present invention is any one of the first through fourth aspects, wherein the static contact angle of water to the wiper blade is 50° or less.

With this aspect, the static angle of water to the wiper blade is 50° or less. Specifically, the cleaning fluid sufficiently easily wets the wiper blade. Because of this, it is possible to effectively move the cleaning fluid from the support surface to the wiper blade, and possible to suppress having the cleaning fluid remain on the conveyor belt, and having the medium to be recorded dirtied by the cleaning fluid.

The recording device of the sixth aspect of the present invention is any one of the first through fifth aspects, further includes a plurality of the wiper blades.

With this aspect, a plurality of the wiper blades are provided, so it is possible to effectively have the cleaning fluid moved from the support surface to the wiper blades, and possible to suppress having the cleaning fluid remain on the conveyor belt, and having the medium to be recorded dirtied by the cleaning fluid.

The recording device of the seventh aspect of the present invention is the sixth aspect, wherein the modulus of rigidity of the plurality of the wiper blades differs from each other.

With this aspect, the modulus of rigidity of the plurality of the wiper blades differs from each other. Specifically, for example, it is possible to have the plurality of wiper blades contact with the support surface in different states. Because of this, it is possible to effectively move the cleaning fluid from the support surface to the wiper blades, and possible to suppress having the cleaning fluid remain on the conveyor belt, and having the medium to be recorded dirtied by the cleaning fluid.

The recording device of the eighth aspect of the present invention is any one of the first through seventh aspects, wherein the wiper blade is movable in directions approaching and separating from the support surface, and it is possible to change the contact surface area on the support surface.

With this aspect, the wiper blade can move in directions approaching and separating from the support surface, and it is possible to change the contact surface area with the support surface. Specifically, while the wiper blade contacts the support surface, by changing the position of the wiper blade to the support surface, it is possible to change the contact surface area of the wiper blade to the support surface. Therefore, for example, in a case when it is difficult to move the cleaning fluid from the support surface to the wiper blade, it is possible to press the wiper blade against the support surface, and to increase the contact surface area of the wiper blade on the support surface. Because of that, it is possible to effectively move the cleaning fluid from the support surface to the wiper blade, and possible to suppress having the cleaning fluid remain on the conveyor belt, and having the medium to be recorded dirtied by the cleaning fluid.

The recording device of the ninth aspect of the present invention is any one of the first through eighth aspects, wherein the wiper blade has a contact area including a part that contacts with cleaning fluid applied to the conveyor belt, and a non-contact area disposed downward in a gravity direction relative to the contact area, and the non-contact area is more hydrophobic than the contact area.

With this aspect, the wiper blade has the contact area including the part that contacts with the cleaning fluid applied to the conveyor belt, and the non-contact area disposed downward in the gravity direction relative to the contact area, and the non-contact area is more hydrophobic than the contact area. Because of this, when the cleaning fluid applied to the contact area moves to the non-contact area by its own weight, it is possible to rapidly move the cleaning fluid from the non-contact area. Specifically, it is possible to rapidly move the cleaning fluid from the wiper blade, and possible to further increase the effect of removing the cleaning fluid applied to the conveyor belt with the wiper blade.

BRIEF DESCRIPTION OF THE DRAWINGS

Referring now to the attached drawings which form a part of this original disclosure.

DETAILED DESCRIPTION OF EMBODIMENTS

Following, we will give a detailed description of the recording device of an embodiment of the present invention while referring to the attached drawings.

First Embodiment (FIG. 1 to FIG. 6)

Figure 1:
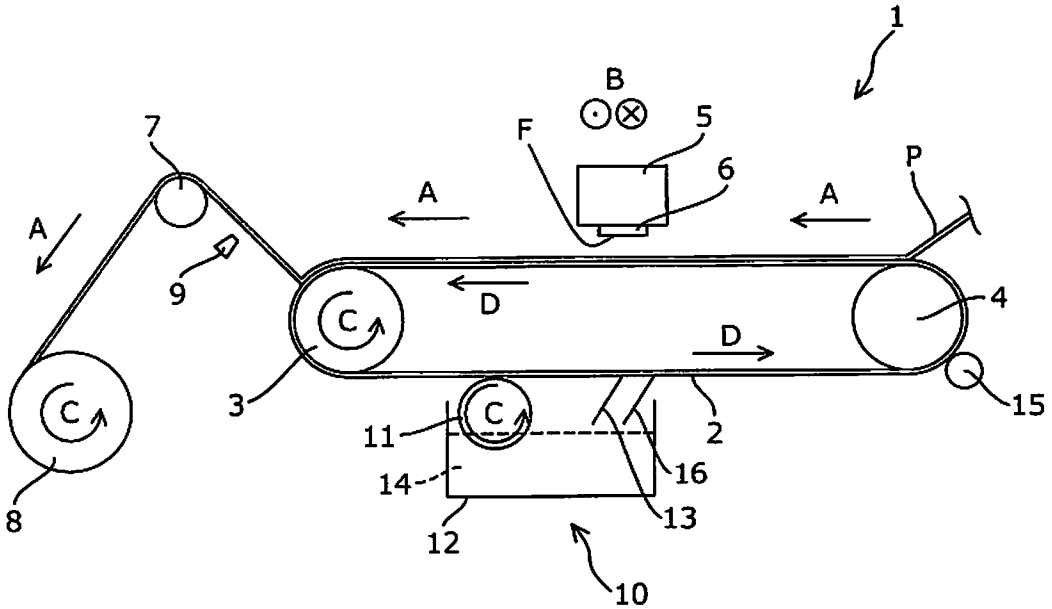
FIG. 1 is a schematic side view showing the recording device of a first embodiment of the present invention.

FIG. 1 is a schematic side view showing a recording device 1 of the first embodiment of the present invention.

The recording device 1 of this embodiment is equipped with a conveyor belt 2 that is stretched across a driving roller 3 and a driven roller 4 that rotate in a rotation direction C, and that supports a medium to be recorded P and conveys it in a conveyance direction A. The recording device 1 of this embodiment is equipped with two rollers as a plurality of rotating bodies, the driving roller 3 and the driven roller 4, but it is also possible to be equipped with three or more rollers, and among those to have a plurality be driving rollers.

The conveyor belt 2 of this embodiment moves in a direction D by the driving roller 3 rotating in the rotation direction C, and conveys the medium to be recorded P in the conveyance direction A.

The conveyor belt 2 of this embodiment is an adhesive belt coated with an adhesive agent that adheres the medium to be recorded P so as to be peelable and holds it on the surface for supporting the medium to be recorded P. However, it is not limited to being this kind of adhesive belt, and can also be a conveyor belt that holds the medium to be recorded P using electrostatic attraction.

Also, a recording head 6 is equipped on a conveyance path of the medium to be recorded P by the conveyor belt 2. The recording device 1 forms a desired image by discharging ink on the medium to be recorded from an ink discharge surface F of the recording head 6 while moving the recording head 6 back and forth in a direction B that crosses the conveyance direction A via a carriage 5.

The recording device 1 of this embodiment is equipped with the recording head 6 that records while moving back and forth, but it is also possible to be a recording device equipped with a so-called line head for which a plurality of nozzles for discharging ink are provided in the direction crossing the conveyance direction A.

Here, a "line head" is a recording head for which the area of the nozzles formed in the direction B crossing the conveyance direction A of the medium to be recorded P is provided so as to be able to cover the entire direction B of the medium to be recorded P, and is used for a recording device that forms images by having one of the recording head and the medium to be recorded P be fixed and having the other one move. It is also possible for the area of the nozzles of direction B of the line head not to cover the entire direction B of all the medium to be recorded P handled by the recording device.

With the recording device 1 of this embodiment, the medium to be recorded P is peeled from the conveyor belt 2 within a designated range, and is wound using a winding unit 8 via a driven roller 7 fixed at a designated position. When winding up the medium to be recorded P, the winding unit 8 rotates the medium to be recorded in the rotation direction C.

A sensor 9 that detects the peeling position of the medium to be recorded P in relation to the conveyor belt 2 is provided in the conveyance path of the medium to be recorded P, between the position at which the medium to be recorded P is peeled from the conveyor belt 2 and the position at which the driven roller 7 is provided.

Here, the sensor 9 is an optical sensor that irradiates light from the direction crossing the surface of the medium to be recorded P, and by the reflected light from the surface of the medium to be recorded P, detects that the medium to be recorded P has been peeled in relation to the conveyor belt 2.

Because of this, for example, using the optical sensor of a constitution for receiving reflected light from the reflecting part provided at the side facing opposite the irradiation part, by irradiating light from the direction along the surface of the medium to be recorded P and detecting that the reflected light is obstructed by the medium to be recorded P, the detection precision level is higher than with a conventional method of detecting that the medium to be recorded P has been peeled in relation to the conveyor belt 2. This is because with this kind of conventional method, because there is a short length (thickness) in the direction crossing the surface of the medium to be recorded P, and there are detection errors due to a skew between the detection timing of the optical sensor and the timing at which the reflected light is blocked by the medium to be recorded P.

Also, the recording device 1 of this embodiment is equipped with a cleaning unit 10 as a cleaning part for cleaning the conveyor belt 2. The cleaning unit 10 is equipped with a cleaning brush 11 which is a contact part that applies cleaning fluid 14 input from a cleaning fluid tank 12 and contacts the conveyor belt 2, and wiper blade 13 and wiper blade 16 that remove the cleaning fluid 14 applied to the conveyor belt 2 by the cleaning brush 11 contacting the conveyor belt 2.

The cleaning fluid 14 with this embodiment is water, but it is not limited to being water, and for example can also be a cleaning fluid such as an aqueous solution containing a detergent component, for example.

Also, the recording device 1 of this embodiment is equipped with a towel roller 15 as a cloth roller for aiding the removal of the cleaning fluid 14 applied to the conveyor belt 2 positioned facing opposite the driven roller 4 sandwiching the conveyor belt 2.

Here, "cloth roller" means a roller for which cloth is used as the contact part with the conveyor belt 2.

The towel roller 15 of this embodiment is constituted to be able to undergo driven rotation in the reverse direction to the rotation direction C along with movement of the conveyor belt 2 in the direction D, but this is not limited to this kind of constitution, and for example can also be constituted to do driving rotation in the rotation direction C.

Next, we will give a detailed description of the cleaning unit 10 of the recording device 1 of this embodiment.

Figure 2:
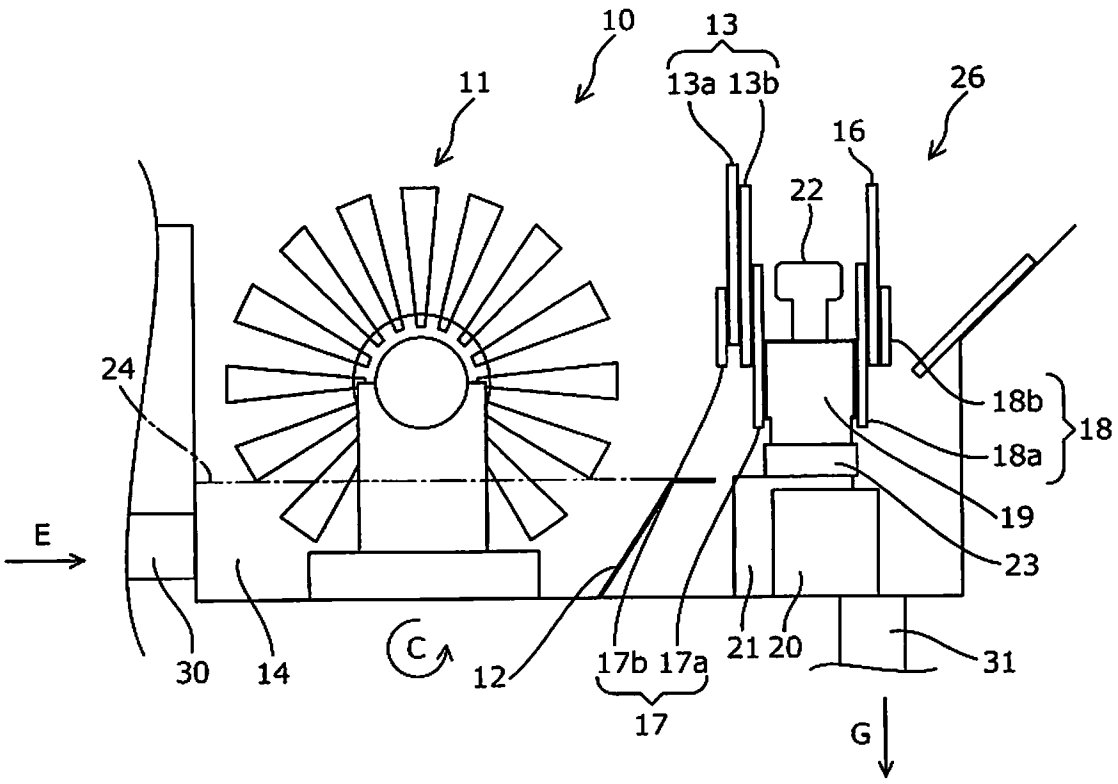
FIG. 2 is a schematic side view showing the cleaning unit of the recording device of the first embodiment of the present invention.

FIG. 2 is a schematic side view showing the cleaning unit 10 of the recording device 1 of this embodiment.

The cleaning fluid 14 is supplied to a cleaning fluid tank 12 in a direction E from a water supply tube 30. Then, the cleaning fluid 14 that overflows from the cleaning fluid tank 12 is exhausted in a direction G from a water exhaust tube 31.

The cleaning brush 11 is provided in the cleaning fluid tank 12, and the bottom part of the cleaning brush 11 reaches downward from a liquid surface 24 of the cleaning fluid 14. Because of this, by the cleaning brush 11 being rotated to drive in the rotation direction C, the cleaning fluid 14 adhered to the cleaning brush 11 adheres to the conveyor belt 2.

The wiper blade 13 is constituted from two layers including a wiper blade 13*a* and 13*b*, and is gripped by a gripping member 17 (gripping members 17*a* and 17*b*). Then, the gripping member 17*a* is fixed to a wiper blade support base 19.

Also, the wiper blade 16 is gripped by a gripping member 18 (gripping members 18*a* and 18*b*). Also, the gripping member 18*a* is fixed to the wiper blade support base 19.

The wiper blade support base 19 is fixed to a wiper blade attachment part 20 by a bolt 22 via a pedestal 21 and a nut 23 fixed by screws 27*a* and 27*b* (see FIG. 6) to the wiper blade attachment part 20.

In this way, the recording device 1 of this embodiment has a wiper blade support unit 26 constituted by the gripping member 17, the gripping member 18, the wiper blade support base 19, the wiper blade attachment part 20, the pedestal 21, the bolt 22, the nut 23 and the like.

FIG. 2 shows the state with the cleaning unit 10 separated from the conveyor belt 2. In this way, in a state with the cleaning unit 10 separated from the conveyor belt 2, both the wiper blades 13 and 16 of this embodiment extend in a vertical direction.

Next, we will describe the state of the cleaning unit 10 of the recording device 1 of this embodiment cleaning the conveyor belt 2.

Figure 3:
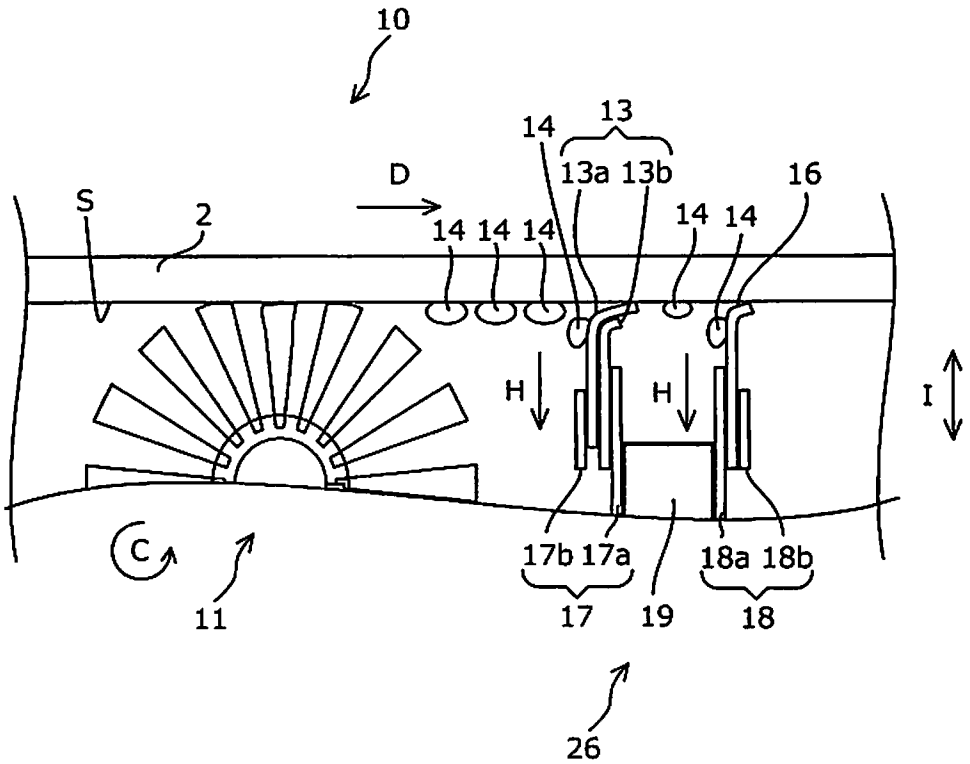
FIG. 3 is a schematic side view showing the cleaning unit of the recording device of the first embodiment of the present invention, showing the state of the conveyor belt cleaned with the cleaning unit.

FIG. 3 is a schematic side view showing the cleaning unit 10 of the recording device 1 of this embodiment, and shows the state of the conveyor belt 2 being cleaned with the cleaning unit 10.

As the cleaning brush 11 is rotated driving in the rotation direction C, the cleaning fluid 14 is adhered to the support surface S of the conveyor belt 2. The recording device 1 of this embodiment removes the cleaning fluid 14 adhered to the support surface S of the conveyor belt 2 from the conveyor belt 2 by having the wiper blades 13 and 16 contact the support surface S of the conveyor belt 2.

Here, the wiper blades 13 and 16 are more hydrophilic than the support surface S, specifically, they are lyophilic in relation to the cleaning fluid 14. Because of this, the recording device 1 of this embodiment can have the cleaning fluid 14 adhered to the conveyor belt 2 moved to the wiper blades 13 and 16. Furthermore, the recording device 1 of this embodiment is able to move the cleaning fluid 14 adhered to the wiper blades 13 and 16 in a direction H which is the gravity direction due to its own weight. With the recording device 1 of this embodiment, both the wiper blades 13 and 16 are constituted so as to extend in the vertical direction, so it is easier for the cleaning fluid 14 to move from the wiper blades 13 and 16 by its own weight.

"Lyophilic" means east to be wet in relation to the cleaning fluid 14, and "lyophobic" means difficult to be wet in relation to the cleaning fluid 14.

As noted above, the recording device 1 of this embodiment is equipped with the conveyor belt 2 for supporting the medium to be recorded P on the support surface S and conveying it. It is also equipped with the cleaning unit 10 that has the cleaning brush 11 that applies the cleaning fluid 14 and contacts the conveyor belt 2, and the wiper blades 13 and 16 that remove the cleaning fluid 14 applied to the conveyor belt 2. Also, the wiper blades 13 and 16 are more hydrophilic than the support surface S (lyophilic in relation to the cleaning fluid 14). Specifically, the cleaning fluid 14 is more easily wetted in relation to the wiper blade 13 and 16 than the support surface S.

With this kind of constitution, the recording device 1 of this embodiment moves the cleaning fluid 14 from the support surface S to the wiper blades 13 and 16. In this way, there is suppression of having the cleaning fluid 14 remain on the conveyor belt 2, and having the medium to be recorded P dirtied by the cleaning fluid 14.

Also, as noted above, the recording device 1 of this embodiment is equipped with a plurality of wiper blades including wiper blades 13 and 16.

Because of this, it is possible to effectively move the cleaning fluid 14 from the support surface S to the wiper blades 13 and 16, and to suppress having the cleaning fluid 14 remain on the conveyor belt 2 and having the medium to be recorded P dirtied by the cleaning fluid 14.

Also, with the recording device 1 of this embodiment, the wiper blades 13*a*, 13*b*, and 16 are constituted using the same material, and the wiper blade 13 is constituted using two layers including the wiper blades 13*a* and 13*b*. Using this kind of constitution, the modulus of rigidity of the wiper blades 13 and 16 as the plurality of wiper blades is made to be different.

In this way, the support surface S is made to contact the wiper blades 13 and 16 in different states, and the cleaning fluid 14 is effectively moved from the support surface S to the wiper blades 13 and 16. Because of this, there is suppression of having the cleaning fluid 14 remain on the conveyor belt 2, and having the medium to be recorded P dirtied by the cleaning fluid 14.

This is not limited to the kind of constitution of the recording device 1 of this embodiment, and for example it is also possible to have a plurality of wiper blades with a different modulus of rigidity, and to have a different modulus of rigidity for each by using wiper blades of different materials.

Also, with the recording device 1 of this embodiment, the static contact angle of the cleaning fluid 14, specifically, the water, to the wiper blades 13 and 16 is 50° or less.

Specifically, the cleaning fluid 14 sufficiently easily wets the wiper blades 13 and 16. Because of this, it is possible to effectively move the cleaning fluid 14 from the support surface S to the wiper blades 13 and 16, and to suppress having the cleaning fluid 14 remain on the conveyor belt 2, and having the medium to be recorded P be dirtied by the cleaning fluid 14.

The recording device 1 of this embodiment uses the same material for the wiper blades 13*a*, 13*b*, and 16, but is not limited to this kind of constitution, and for example, it is also possible to use wiper blades of different materials as the plurality of wiper blades, and to also have a static contact angle of 50° or less.

Also, with the recording device 1 of this embodiment, the static contact angle of the cleaning fluid 14, specifically, the water, to the wiper blades 13 and 16 is 10° or more less than the static contact angle of the cleaning fluid 14 to the support surface S.

Specifically, the cleaning fluid 14 is sufficiently easier to wet on the wiper blade 13 and 16 than the support surface S. Because of this, it is possible to effectively move the cleaning fluid 14 from the support surface S to the wiper blades 13 and 16, and to suppress having the cleaning fluid 14 remain on the conveyor belt 2, and having the medium to be recorded P be dirtied by the cleaning fluid 14.

Also, as shown in FIG. 3, the wiper blades 13 and 16 of the recording device 1 of this embodiment can move in the direction 1 approaching and separating from the support surface S, and the constitution is such that it is possible to change the contact surface area on the support surface S.

Specifically, by changing the position of the wiper blades 13 and 16 in relation to the support surface S while having the wiper blades 13 and 16 in contact with the support surface S, it is possible to change the contact surface area of the wiper blades 13 and 16 in relation to the support surface S. Therefore, for example, when it is difficult for the cleaning fluid 14 to move from the support surface S to the wiper blades 13 and 16, it is possible to push the wiper blades 13 and 16 against the support surface S and to increase the contact surface area of the wiper blades 13 and 16 on the support surface S. Because of this, it is possible to effectively move the cleaning fluid 14 from the support surface S to the wiper blades 13 and 16, and possible to suppress having the cleaning fluid 14 remain on the conveyor belt 2, and having the medium to be recorded P dirtied by the cleaning fluid 14.

Next, we will describe the positional relationship of the cleaning unit 10 to the conveyor belt 2, and the positional relationship of the wiper blade support unit 26 to the cleaning unit 10.

Figure 4:
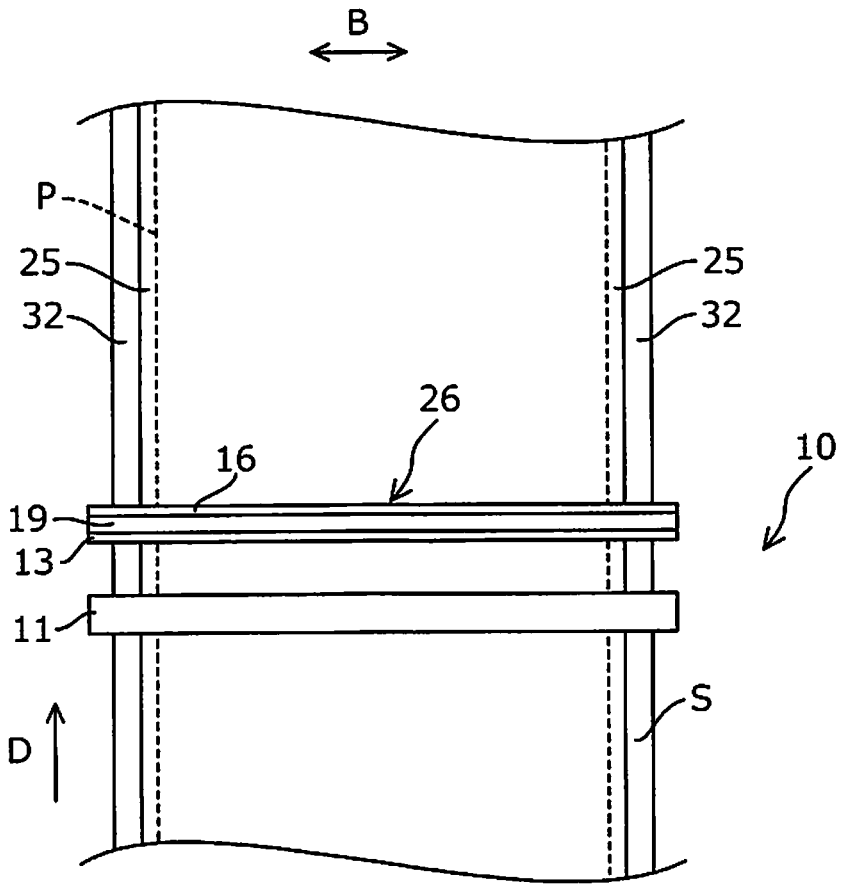
FIG. 4 is a schematic bottom view showing the positional relationship of the recording device conveyor belt and the cleaning unit of the first embodiment of the present invention.

FIG. 4 is a schematic bottom view showing the positional relationship of the conveyor belt 2 and the cleaning unit 10 of the recording device 1 of this embodiment, and shows the state seen from below the support surface S of the conveyor belt 2. Here, in the state with the support surface S facing downward, the medium to be recorded P is not supported on the support surface S. However, to describe the positional relationship of the adhesive surface 25 of the support surface S and the support position (adhered position) of the medium to be recorded P on the non-adhesive surface 32, with FIG. 4, the support position of the medium to be recorded P is shown by a dotted line.

With the recording device 1 of this embodiment, in the direction B corresponding to the width direction of the conveyor belt 2, the cleaning brush 11, and the wiper blades 13 and 16 are provided exceeding both sides of the width of the conveyor belt 2.

Also, the wiper blade support unit 26 is provided at the center part of the wiper blades 13 and 16 in the direction B. Using this kind of constitution, there is suppression of having a contact failure such as by the wiper blades 13 and 16 being bent near the center part in the direction B, and having uneven contact by which there is non-contact with the conveyor belt 2.

Also, the support surface S of the conveyor belt 2 of this embodiment has an adhesive surface 25 as the support surface for which the medium to be recorded P coated with an adhesive agent is supported in a broader range than the support position of the medium to be recorded P in the direction B, and a non-adhesive surface 32 not coated with the adhesive agent on both sides of the adhesive surface 25 in the direction B. Here, the non-adhesive surface 32 is more lyophilic in relation to the cleaning fluid 14 than the adhesive surface 25. Also, the wiper blades 13 and 16 are more hydrophilic (lyophilic in relation to the cleaning fluid 14) than the non-adhesive surface 32.

In this way, the conveyor belt 2 of this embodiment is a so-called adhesive belt having the adhesive surface 25 on the support surface S. The conveyor belt 2 of this embodiment has this kind of constitution, so it is easy to move the cleaning fluid 14 from the adhesive surface 25 that supports the medium to be recorded P to the non-adhesive surface 32, and easy to move the cleaning fluid 14 from the adhesive surface 25 and the non-adhesive surface 32 to the wiper blades 13 and 16. Because of this, there is effective suppression of having the cleaning fluid 14 remain on the adhesive surface 25 of the conveyor belt 2, and having the medium to be recorded P dirtied by the cleaning fluid 14.

Next, we will give a detailed description of the wiper blade support unit 26.

Figure 5:
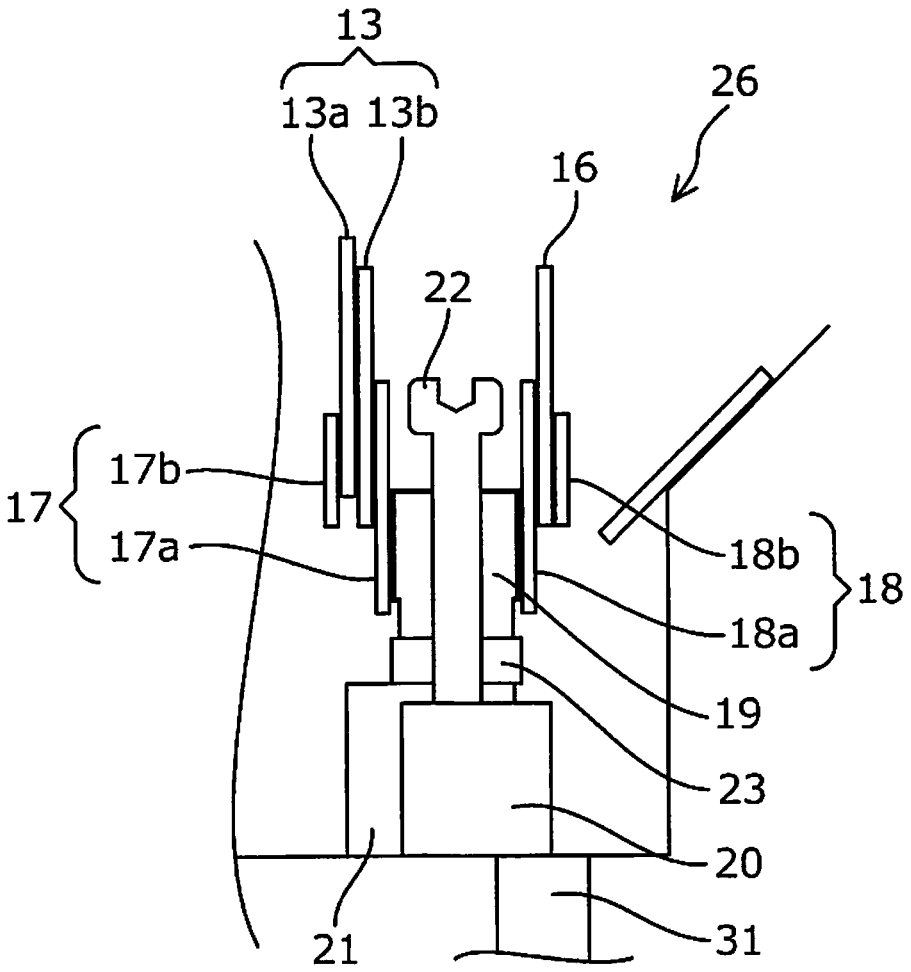
FIG. 5 is a schematic side cross section view showing the wiper blade support unit with the cleaning unit of the recording device of the first embodiment of the present invention.

FIG. 5 is a schematic side cross section view showing the wiper blade support unit 26 of the cleaning unit 10 of the recording device 1 of this embodiment. Also, FIG. 6 is a schematic front view showing the wiper blade support unit 26 of the cleaning unit 10 of the recording device 1 of this embodiment.

As shown in FIG. 5, the wiper blade 13 is gripped by the gripping members 17*a* and 17*b*, and the gripping member 17*a* is fixed to the wiper blade support base 19. Also, the wiper blade 16 is gripped by the gripping members 18*a* and 18*b*, and the gripping member 18*a* is fixed to the wiper blade support base 19. Also, the wiper blade support base 19 of the center part in the direction B corresponding to the width direction of the conveyor belt 2 has height adjustment done on the wiper blade attachment part 20 by tightening of the bolt 22 of the wiper blade support unit 26 via the pedestal 21 and the nut 23, and is fixed by the screws 27*a* and 27*b*.

Figure 6:
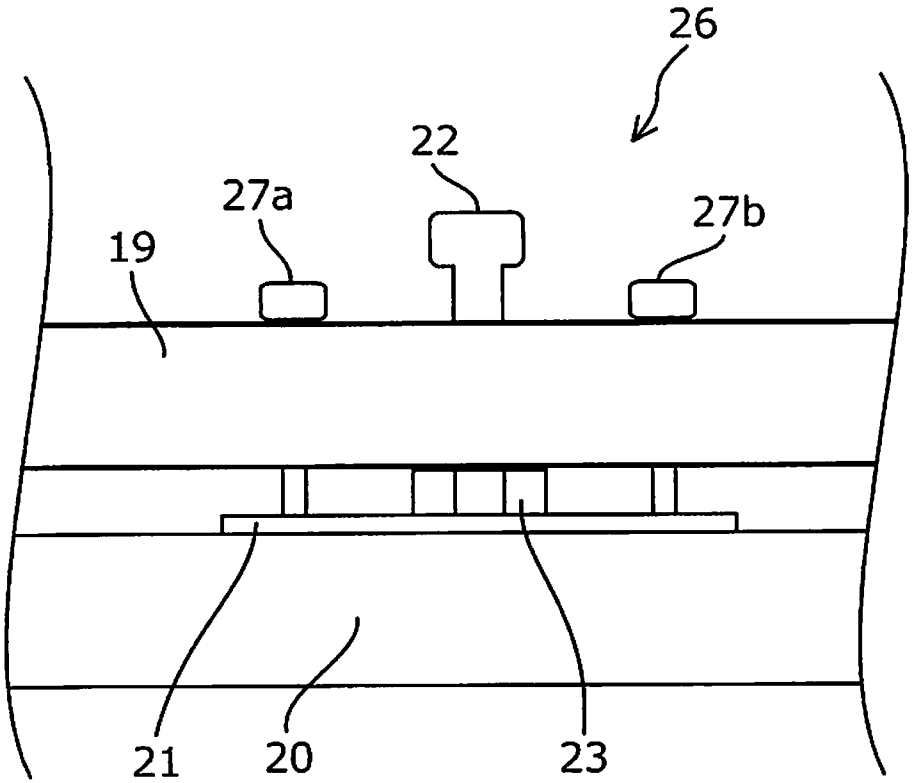
FIG. 6 is a schematic front view showing the wiper blade support unit with the cleaning unit of the recording device of the first embodiment of the present invention.

Also, as shown in FIG. 6, the wiper blade support base 19 and the pedestal 21 are fixed by the screws 27*a* and 27*b*.

The wiper blade support unit 26, by using this kind of constitution, has the wiper blades 13 and 16 fixed to the wiper blade attachment part 20 of the cleaning unit 10.

Figure 7:
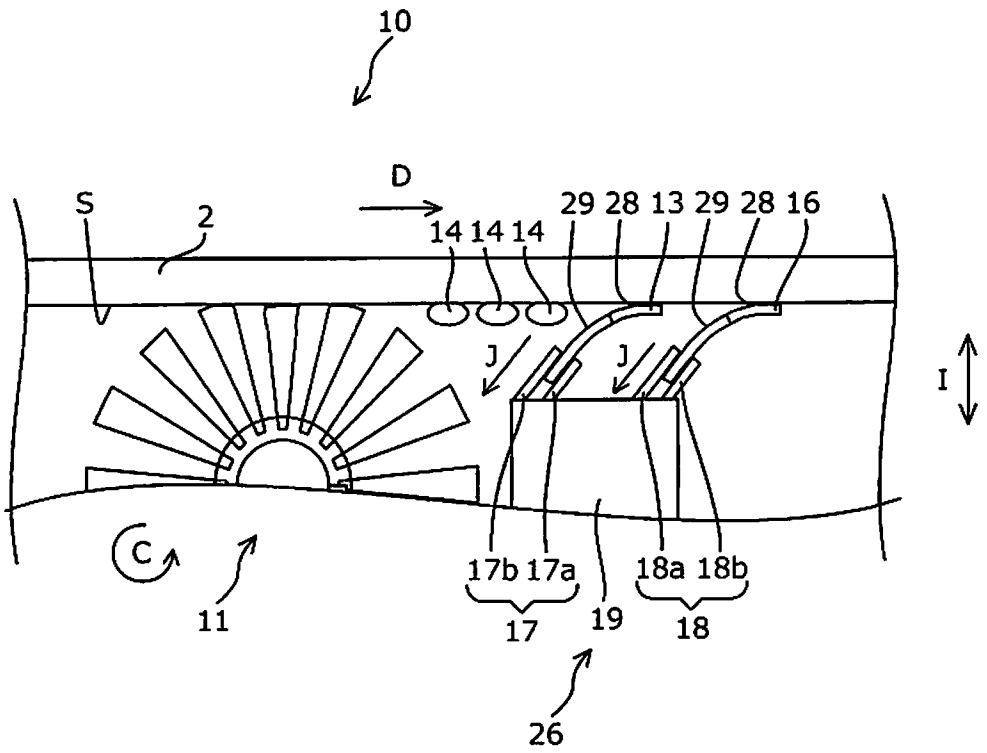
FIG. 7 is a schematic side view showing the cleaning unit of the recording device of a second embodiment of the present invention.

Second Embodiment (FIG. 7)

Next, we will give a detailed description of the recording device of the second embodiment while referring to the attached drawing.

FIG. 7 is a schematic side view showing the cleaning unit 10 of the recording device 1 of this embodiment. The constitutional members common to the embodiment noted above are shown with the same code numbers, and a detailed description of them is omitted.

The cleaning unit 10 of this embodiment has the wiper blade 13 constituted with one layer, both the wiper blades 13 and 16 extend tilting from the vertical direction while curving, and both the wiper blades 13 and 16 have areas 28 and 29 of differing wettability to the cleaning fluid 14, while the remainder is the same constitution as that of the cleaning unit 10 of the first embodiment.

As noted above, the wiper blades 13 and 16 of this embodiment have areas 28 and 29 of different wettability to the cleaning fluid 14. In more detail, the wiper blades 13 and 16 both have the contact area 28 including a part that contacts the cleaning fluid 14 applied to the conveyor belt 2 and the non-contact area 29 provided further below the gravity direction than the contact area 28. Also, the non-contact area 29 is more hydrophobic (lyophobic to the cleaning fluid 14) than the contact area 28. Also, it is possible to have a constitution for which the blade tip part overall including the contact area 28 of the wiper blade 13 and the wiper blade 16 is lyophilic, and the middle part of the blade including the non-contact area 29 is more lyophobic to the cleaning fluid 14 than the contact area 28.

The wiper blades 13 and 16 of this embodiment have this kind of constitution, so when the cleaning fluid 14 applied to the contact area 28 moves to the non-contact area 29 by its own weight, it is possible to rapidly move the cleaning fluid 14 from the non-contact area 29 in a direction J. Specifically, it is possible to rapidly move the cleaning fluid 14 from the wiper blades 13 and 16, and it is possible to further increase removing of the cleaning fluid 14 applied to the conveyor belt 2 with the wiper blades 13 and 16.

Figure 8:
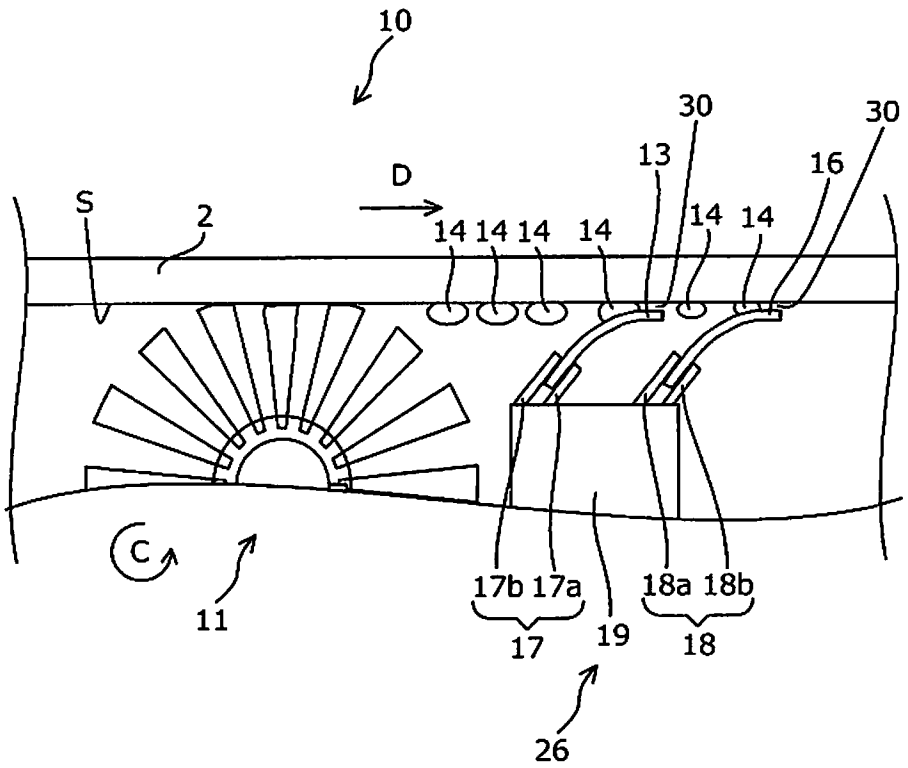
FIG. 8 is a schematic side view showing the cleaning unit of the recording device of a third embodiment of the present invention.

Third Embodiment (FIG. 8)

Next, we will give a detailed description of the recording device of the third embodiment while referring to the attached drawing.

FIG. 8 is a schematic side view showing the cleaning unit 10 of the recording device 1 of this embodiment. The constitutional member common to the embodiments noted above are shown with the same code numbers, and a detailed description is omitted.

The cleaning unit 10 of this embodiment is provided with a space 30 between the wiper blades 13 and 16 and the support surface S of the conveyor belt 2, and the wiper blades 13 and 16 and the support surface S are not in contact, and other than this, the constitution is the same as the cleaning unit 10 of the second embodiment.

As noted above, the wiper blades 13 and 16 of this embodiment are provided at positions not in contact with the support surface S of the conveyor belt 2. However, as shown in FIG. 8, the wiper blades 13 and 16 are provided at positions in contact with the cleaning fluid 14 applied to the conveyor belt 2.

Here, "positions in contact with the cleaning fluid 14 applied to the conveyor belt 2" means not that it is necessary to be at a position in contact with all the cleaning fluid applied to the conveyor belt, but that it is sufficient to be at a position in contact with a portion of the cleaning fluid applied to the conveyor belt.

The wiper blades 13 and 16 of this embodiment have this kind of constitution, so while effectively moving the cleaning fluid 14 from the support surface S to the wiper blades 13 and 16, and while suppressing having the medium to be recorded P be dirtied by the cleaning fluid 14, wearing of the wiper blades 13 and 16 and the support surface S due to contact of the wiper blades 13 and 16 on the support surface S is suppressed.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A recording device comprising:

a conveyor belt configured to support a medium on a support surface and convey the medium; and a wiper blade abuttable with the conveyor belt, the wiper blade being more hydrophilic than the support surface, and the static contact angle of water to the wiper blade being smaller by 10° or more than the static contact angle of water to the support surface.

2. The recording device according to claim 1, wherein the conveyor belt has the support surface that supports the medium and is coated by an adhesive agent, and a non-adhesive surface that is not coated by the adhesive agent, the non-adhesive surface of the conveyor belt is more hydrophilic than the support surface of the conveyor belt, and the wiper blade is more hydrophilic than the non-adhesive surface of the conveyor belt.

3. The recording device according to claim 1, wherein the static contact angle of water to the wiper blade is 50° or less.

4. The recording device according to claim 1, further comprising a plurality of the wiper blades.

5. The recording device according to claim 4, wherein the modulus of rigidity of the plurality of the wiper blades differs from each other.

6. The recording device according to claim 1, wherein the wiper blade is movable in directions approaching and separating from the support surface.

7. The recording device according to claim 1, wherein the wiper blade has a contact area including a part that contacts with cleaning fluid applied to the conveyor belt, and a non-contact area disposed downward in a gravity direction relative to the contact area, and the non-contact area is more hydrophobic than the contact area.

8. The recording device according to claim 1, wherein the wiper blade is movable with respect to the support surface while having the wiper blade in contact with the support surface so as to change a contact surface area of the wiper blade in relation to the support surface.

9. A recording device comprising:

a conveyor belt configured to support a medium on a support surface and convey the medium; and a wiper blade disposed at a position where the wiper blade contacts with cleaning fluid applied to the conveyor belt, and does not contact with the support surface during cleaning of the conveyor belt, the wiper blade being more hydrophilic than the support surface, and the static contact angle of water to the wiper blade being smaller by 10° or more than the static contact angle of water to the support surface.

10. The recording device according to claim 9, wherein the conveyor belt has the support surface that supports the medium and is coated by an adhesive agent, and a non-adhesive surface that is not coated by the adhesive agent, the non-adhesive surface of the conveyor belt is more hydrophilic than the support surface of the conveyor belt, and the wiper blade is more hydrophilic than the non-adhesive surface of the conveyor belt.

11. The recording device according to claim 9, wherein the static contact angle of water to the wiper blade is 50° or less.

12. The recording device according to claim 9, further comprising a plurality of the wiper blades.

13. The recording device according to claim 12, wherein the modulus of rigidity of the plurality of the wiper blades differs from each other.

14. The recording device according to claim 9, wherein the wiper blade is movable in directions approaching and separating from the support surface.

15. The recording device according to claim 9, wherein the wiper blade has a contact area including a part that contacts with cleaning fluid applied to the conveyor belt, and a non-contact area disposed downward in a gravity direction relative to the contact area, and the non-contact area is more hydrophobic than the contact area.

* * * * *